US012108880B2

(12) United States Patent
Shi

(10) Patent No.: US 12,108,880 B2
(45) Date of Patent: Oct. 8, 2024

(54) INFLATABLE BED

(71) Applicant: DONGGUAN HONGYU PLASTIC CO., LTD, Dongguan (CN)

(72) Inventor: Juying Shi, Dongguan (CN)

(73) Assignee: DONGGUAN HONGYU PLASTIC CO., LTD, Guangdong (CN)

( * ) Notice: Subject to any disclaimer, the term of this patent is extended or adjusted under 35 U.S.C. 154(b) by 0 days.

(21) Appl. No.: 18/334,358

(22) Filed: Jun. 13, 2023

(65) Prior Publication Data

US 2024/0298813 A1 Sep. 12, 2024

Related U.S. Application Data

(63) Continuation of application No. 18/194,198, filed on Mar. 31, 2023.

(30) Foreign Application Priority Data

Mar. 7, 2023 (CN) ..... 202320428505.2

(51) Int. Cl.
*A47C 27/08* (2006.01)
*A47C 27/00* (2006.01)

(52) U.S. Cl.
CPC ..... *A47C 27/082* (2013.01); *A47C 27/087* (2013.01); *A47C 27/081* (2013.01)

(58) Field of Classification Search
CPC .... A47C 27/082; A47C 27/087; A47C 27/081
USPC ..... 5/706, 712, 711
See application file for complete search history.

(56) References Cited

U.S. PATENT DOCUMENTS 4,006,501 A * 2/1977 Phillips ..... A47C 27/085 5/687
4,055,867 A * 11/1977 Phillips ..... A47C 27/085 5/687
4,078,960 A * 3/1978 Phillips ..... A47C 27/081 156/227
4,101,995 A * 7/1978 Phillips ..... A47C 27/085 5/687
6,332,760 B1 * 12/2001 Chung ..... F04D 25/0673 5/706
6,543,073 B2 * 4/2003 Wu ..... A47C 7/021 5/713

(Continued)

FOREIGN PATENT DOCUMENTS

EP 3078301 A1 * 10/2016 ..... A47C 27/081
EP 3192401 A1 * 7/2017 ..... A47C 27/081

*Primary Examiner* — Robert G Santos
(74) *Attorney, Agent, or Firm* — Tarolli, Sundheim, Covell & Tummino LLP

(57) ABSTRACT

Provided is a novel inflatable bed, which relates to the field of articles for daily use. The novel inflatable bed comprises a bed body and a closed annular pull strap. The bed body is provided with a main air chamber. The closed annular pull strap has two annular edges, the closed annular pull strap is provided in the main air chamber, the two annular edges are respectively welded to two adjacent bed walls of the bed body, so that the main air chamber is separated to form a central air chamber and an edge air chamber. A weld seam formed by welding at least one of the two annular edges with the bed body has at least one broken portion, so as to form a channel making the central air chamber and the edge air chamber in communication at the broken portion.

9 Claims, 3 Drawing Sheets

(56) References Cited

U.S. PATENT DOCUMENTS 6,793,469 B2 * 9/2004 Chung ..... F04D 29/503 417/423.15
7,039,972 B2 * 5/2006 Chaffee ..... F04D 29/602 5/655.3
7,089,618 B1 * 8/2006 Metzger ..... A47C 27/087 5/709
7,269,866 B2 * 9/2007 Liu ..... A47C 27/082 5/710
7,353,555 B2 * 4/2008 Lau ..... A47C 27/081 5/711
7,376,994 B2 * 5/2008 Wu ..... A47C 27/081 5/904
7,922,461 B2 * 4/2011 Wang ..... F04D 25/084 417/423.15
RE42,559 E * 7/2011 Wang ..... F04D 29/601 5/706
9,211,018 B2 * 12/2015 Wang ..... F04D 29/503
9,247,827 B2 * 2/2016 Lin ..... A47C 27/081
10,398,235 B2 * 9/2019 Lin ..... A47C 27/10
10,687,633 B2 * 6/2020 Liu ..... A47C 27/087
10,945,533 B1 * 3/2021 Shi ..... A47C 27/081
11,058,226 B2 * 7/2021 Hsu ..... A47C 27/087
11,564,505 B2 * 1/2023 Liu ..... A47C 27/16
11,583,099 B2 * 2/2023 Li ..... A47C 27/10
11,903,489 B1 * 2/2024 Zhong ..... A47C 27/088
11,910,930 B2 * 2/2024 Shi ..... F16K 31/53
11,937,703 B2 * 3/2024 Shi ..... A47C 27/082
2001/0026763 A1 * 10/2001 Chung ..... F04D 25/0673 417/360
2001/0044969 A1 * 11/2001 Chaffee ..... F04D 29/602 5/655.3
2003/0037378 A1 * 2/2003 Wu ..... A47C 7/021 5/654
2004/0037717 A1 * 2/2004 Wang ..... F04D 29/601 417/411
2005/0118046 A1 * 6/2005 Wang ..... F04D 25/0673 417/423.15
2006/0218728 A1 * 10/2006 Liu ..... A47C 27/10 5/710
2007/0124864 A1 * 6/2007 Lau ..... A47C 27/081 5/711
2007/0169272 A1 * 7/2007 Wu ..... A47C 27/081 5/713
2008/0000030 A1 * 1/2008 Wang ..... A47C 27/087 5/713
2015/0201760 A1 * 7/2015 Lin ..... A47C 27/087 5/710
2016/0183692 A1 * 6/2016 Lin ..... A47C 27/081 5/710
2017/0196368 A1 * 7/2017 Liu ..... A47C 27/16
2017/0215599 A2 * 8/2017 Lin ..... A47C 27/10
2018/0160820 A1 * 6/2018 Hsu ..... F04B 39/12
2020/0315366 A1 * 10/2020 Liu ..... A47C 27/16
2021/0169232 A1 * 6/2021 Hou ..... A47C 27/087
2021/0196053 A1 * 7/2021 Li ..... A47C 27/10
2022/0202198 A1 * 6/2022 Li ..... A47C 27/087
2023/0098052 A1 * 3/2023 Shi ..... A47C 27/082 5/706
2023/0122867 A1 * 4/2023 Liu ..... A47C 27/081 5/709
2023/0218091 A1 * 7/2023 Shi ..... F16K 31/53 5/710
2024/0016300 A1 * 1/2024 Zhong ..... A47C 27/082
2024/0016303 A1 * 1/2024 Shi ..... A47C 27/082
2024/0016304 A1 * 1/2024 Li ..... A47C 27/082

* cited by examiner

INFLATABLE BED

CROSS-REFERENCE TO RELATED APPLICATION

This patent application is a Continuation of U.S. patent application Ser. No. 18/194,198, filed on Mar. 31, 2023, entitled NOVEL INFLATABLE BED, which claims the benefit and priority of Chinese Patent Application No. 202320428505.2, filed on Mar. 7, 2023, the disclosure of which is incorporated by reference herein in its entirety as part of the present application.

TECHNICAL FIELD

The present disclosure relates to the field of articles for daily use, and particularly to a novel inflatable bed.

BACKGROUND ART

The inflatable bed refers to a bed that expands and becomes large in volume after being inflated. The inflatable bed is flexible and elastic, is not easy to deform, has relatively high comfort in use, and can discharge gas when not in use. The inflatable bed has a small volume, can be folded and stored, and is convenient to carry and transport. At present, since a mattress with a single air chamber has a simple production process and is easy to manufacture, most of the inflatable mattresses on the market have a single air chamber, and an inflator pump used for the mattress with a single air chamber also has a single air chamber, wherein the entire air chamber inside the mattress is inflated and deflated during inflation and deflation. However, the inflatable bed with a single air chamber is easy to collapse at edges, and use effect is not ideal. Inflatable bed with multiple air chambers emerges in the market. A relatively common inflatable bed with multiple air chambers is an inflatable bed with three air chambers, in which an inclined pull strap is provided, and a bed body is strengthened through the inclined pull strap, improving the stability.

According to the inventor's research, the existing inflatable bed with multiple air chambers has the following shortcomings:

the multiple air chambers are in communication with each other by means of through holes provided on the inclined pull strap, in this way, in the process of manufacturing the inflatable bed, the inclined pull strap needs to be first connected to the bed body, and then the through holes are provided on the inclined pull strap, which process is cumbersome and has low efficiency and a high cost; moreover, due to the configuration of the through holes, the structure of the inclined pull strap is destroyed, so that the tensile strength is weakened, and the service lifetime is short.

SUMMARY

The present disclosure aims at providing a novel inflatable bed which can simplify the process, improve the efficiency, reduce the cost, and prolong the service lifetime.

Embodiments of the present disclosure are realized as follows:

the present disclosure provides a novel inflatable bed, including:

a bed body with a main air chamber; and at least one closed annular pull strap, wherein the closed annular pull strap has two annular edges, the closed annular pull strap is provided in the main air chamber, the two annular edges are respectively welded to two adjacent bed walls of the bed body, so that the main air chamber is separated by the closed annular pull strap to form a central air chamber and an edge air chamber, and a weld seam formed by welding at least one of the two annular edges with the bed body has at least one broken portion, so as to form, at the broken portion, a channel making the central air chamber and the edge air chamber in communication.

In an optional embodiment, the two annular edges are a first annular edge and a second annular edge respectively; the bed body includes a top wall, a surrounding wall, and a bottom wall, the surrounding wall has two openings, the top wall and the bottom wall are both in sealed connection with the surrounding wall, so as to close the two openings; the first annular edge is welded to the top wall or the bottom wall, and the second annular edge is welded to the surrounding wall.

In an optional embodiment, a weld seam formed by welding the first annular edge to the top wall or the bottom wall has at least one of the broken portions.

In an optional embodiment, a weld seam formed by welding the first annular edge to the top wall or the bottom wall has a plurality of the broken portions, and the plurality of the broken portions are arranged at intervals in a circumferential direction of the first annular edge.

In an optional embodiment, the first annular edge has a plurality of bending portions arranged at intervals in a circumferential direction thereof, the plurality of the broken portions cooperate with the plurality of the bending portions in one-to-one correspondence, and each of the broken portions is located at the corresponding bending portion.

In an optional embodiment, two closed annular pull straps are provided, one of the two closed annular pull straps is simultaneously welded to the top wall and the surrounding wall, and the other one of the two closed annular pull straps is simultaneously welded to the bottom wall and the surrounding wall.

In an optional embodiment, the first annular edge or the second annular edge is welded to a bed wall of the bed body by a heat-sealing process.

In an optional embodiment, the novel inflatable bed further includes an inflator pump, the inflator pump is mounted on the bed body, and the inflator pump is configured to inflate the central air chamber or the edge air chamber.

In an optional embodiment, the novel inflatable bed further includes a reinforcing pull strap, the reinforcing pull strap is provided in the central air chamber, and the reinforcing pull strap is fixedly connected to the bed wall of the bed body.

The embodiments of the present disclosure have the following beneficial effects:

to sum up, in the novel inflatable bed provided in the present embodiment, the closed annular pull strap is fixedly connected to the bed body by one-step welding molding process, and in the welding process, at least one of two annular edges of an annular cable-stayed partition plate is not completely welded to the bed wall of the bed body, that is, the weld seam formed after welding the annular edge to the bed wall is not a complete annular weld seam, but has at least one broken portion, wherein the closed annular pull strap and the bed body have a gap and form a channel at the broken portion, and the central air chamber and the edge air chamber are in communication through the channel. In this way, the one-step welding process not only realizes the connection between the closed annular pull strap and the bed body, but also forms the channel making adjacent air chambers in communication, which process is simple and has high efficiency. During inflation, the description is made by taking that an inflation hole is provided in the central air chamber as an example. Gas in the central air chamber can enter the edge air chamber from the channel, to realize inflation of the central air chamber and the edge air chamber at the same time, thus the inflating efficiency is high. After the inflation is completed, the closed annular pull strap functions as strengthening, edges of the bed body are not easy to collapse, and the inflatable bed is comfortable to use and highly safe. Meanwhile, since the overall structure of the closed annular pull strap is not destroyed, the closed annular pull strap has strong tensile strength, is not easily damaged in use, and has a long service lifetime and a low use cost.

BRIEF DESCRIPTION OF DRAWINGS

In order to more clearly illustrate technical solutions of embodiments of the present disclosure, drawings which need to be used in the embodiments will be introduced below briefly, and it should be understood that the drawings below merely show some embodiments of the present disclosure, therefore should not be considered as limitation on the scope, and a person ordinarily skilled in the art still could obtain other relevant drawings according to these drawings, without using any creative efforts.

REFERENCE SIGNS

Figure 1:
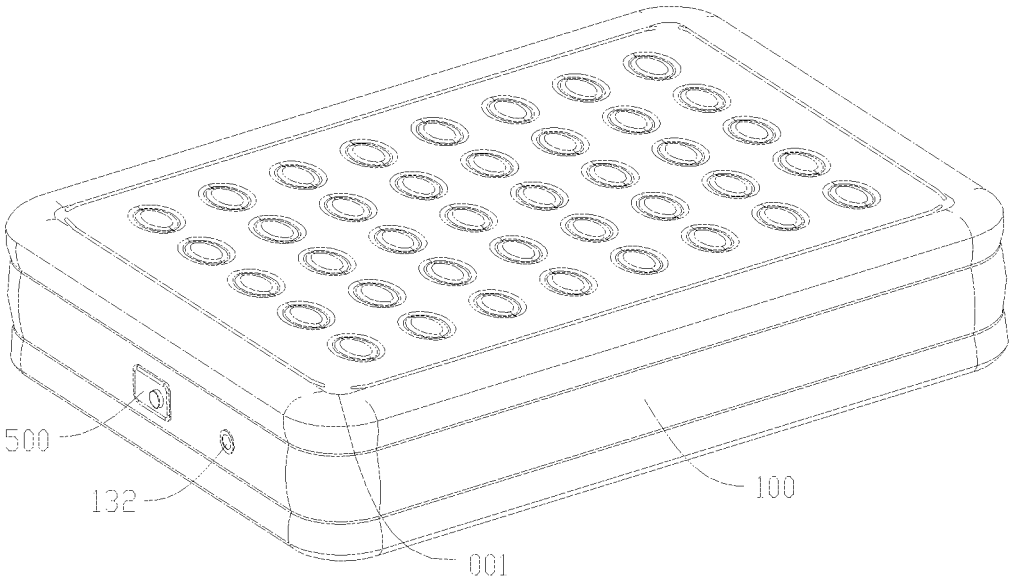
FIG. 1 is a structural schematic diagram of a novel inflatable bed in an embodiment in the present disclosure.
Figure 2:
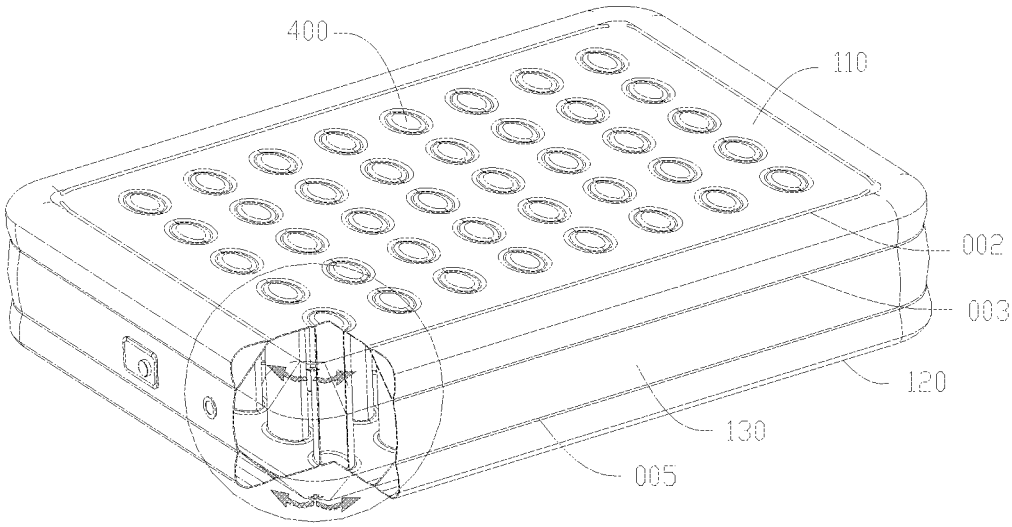
FIG. 2 is a partial sectional structural schematic diagram of the novel inflatable bed in an embodiment of the present disclosure.

001—broken portion; 002—first weld seam; 003—second weld seam; 004—third weld seam; 005—fourth weld seam; 100—bed body; 101—first edge air chamber; 102—second edge air chamber; 103—central air chamber; 110—top wall; 120—bottom wall; 130—surrounding wall; 131—opening; 132—exhaust hole; 200—first closed annular pull strap; 210—first annular edge; 220—second annular edge; 300—second closed annular pull strap; 310—third annular edge; 320—fourth annular edge; 400—reinforcing pull strap; 500—inflator pump.

DETAILED DESCRIPTION OF EMBODIMENTS

In order to make objectives, technical solutions, and advantages of the embodiments of the present disclosure clearer, the technical solutions in the embodiments of the present disclosure will be described clearly and completely below in conjunction with the drawings in the embodiments of the present disclosure, and apparently, some but not all embodiments of the present disclosure are described. Generally, components in the embodiments of the present disclosure described and shown in the drawings herein may be arranged and designed in different configurations.

Therefore, the detailed description below of the embodiments of the present disclosure provided in the drawings is not intended to limit the claimed scope of the present disclosure, but merely represents chosen embodiments of the present disclosure. Based on the embodiments in the present disclosure, all of other embodiments obtained by those ordinarily skilled in the art without using any creative efforts shall fall within the scope of protection of the present disclosure.

It should be noted that similar reference signs and letters represent similar items in the following drawings, therefore, once a certain item is defined in one drawing, it is not needed to be further defined or explained in subsequent drawings.

In the description of the present disclosure, it should be noted that orientation or positional relationships indicated by terms such as "center", "upper", "lower", "left", "right", "vertical", "horizontal", "inner", and "outer" are based on orientation or positional relationships as shown in the drawings, or orientation or positional relationships of a product of the present disclosure when being conventionally placed in use, merely for facilitating describing the present disclosure and simplifying the description, rather than indicating or suggesting that related devices or elements have to be in the specific orientation or configured and operated in a specific orientation, therefore, they should not be construed as limitation to the present disclosure. Besides, terms "first", "second", "third", etc. are merely for distinguishing the description, but should not be construed as indicating or implying importance in the relativity.

Moreover, terms "horizontal", "vertical" and the like do not mean that the parts are required to be absolutely horizontal or overhanging, but may be slightly inclined. For example, by "horizontal" it merely means that a structure is more horizontal in comparison with "vertical", rather than being completely horizontal, while the structure can be slightly inclined.

In the description of the present disclosure, it should be further noted that, unless otherwise specifically specified and defined, the terms "set", "install", "link", and "connect" should be understood in a broad sense, for example, a connection may be a fixed connection, a detachable connection, or an integrated connection; it may be a mechanical connection or an electrical connection; it may be direct joining or indirect joining through an intermediate medium, and it also may be inner communication between two elements. For a person ordinarily skilled in the art, specific meanings of the above-mentioned terms in the present disclosure could be understood according to specific circumstances.

Currently, an inflatable bed with three air chambers includes a bed body, a first inclined reinforcing pull strap 400 and a second inclined reinforcing pull strap 400, wherein the first inclined reinforcing pull strap 400 is connected to a top portion and a periphery portion of the bed body, the second inclined reinforcing pull strap 400 is connected to a bottom portion and the periphery portion of the bed body, and in order to achieve communication between the air chambers, through holes are provided on both the first inclined reinforcing pull strap 400 and the second inclined reinforcing pull strap 400. In this way, when manufacturing the inflatable bed with three air chambers in the prior art, two steps are required. One step is fixedly connecting the inclined reinforcing pull strap 400 to the bed body, and the other step is providing holes on the inclined reinforcing pull strap 400, which process is cumbersome and has low efficiency. Meanwhile, as the inclined reinforcing pull strap 400 is provided with holes, the integrity of the inclined reinforcing pull strap 400 is destroyed, the tensile strength of the inclined reinforcing pull strap 400 is weakened, and the service lifetime is short.

In view of this, the designer provides a novel inflatable bed, which has a simple manufacturing process, a high processing efficiency, and a low manufacturing cost, and meanwhile, the inflatable bed has a high overall strength and a long service lifetime.

Referring to FIG. 1-FIG. 4, in the present embodiment, the novel inflatable bed includes a bed body 100 and at least one closed annular pull strap. The bed body 100 is provided with a main air chamber. The closed annular pull strap has two annular edges, and the closed annular pull strap is provided in the main air chamber, wherein the two annular edges are respectively welded to two adjacent bed walls of the bed body 100, so that the main air chamber is separated by the closed annular pull strap to form a central air chamber 103 and an edge air chamber. A weld seam formed by welding at least one of the two annular edges with the bed body 100 has at least one broken portion 001, so as to form a channel making the central air chamber 103 and the edge air chamber in communication at the broken portion 001.

It can be seen from the above description that in the novel inflatable bed provided in the present embodiment, the closed annular pull strap is fixedly connected to the bed body 100 by one-step welding molding process, and in the welding process, at least one of two annular edges of an annular cable-stayed partition plate is not completely welded to the bed wall of the bed body 100, that is, the weld seam formed after welding the annular edge to the bed wall is not a complete annular weld seam, but has at least one broken portion 001. The closed annular pull strap and the bed body 100 have a gap and form a channel at the broken portion 001, and the central air chamber 103 and the edge air chamber are in communication through the channel. In this way, the one-step welding process not only realizes the connection between the closed annular pull strap and the bed body 100, but also forms the channel making adjacent air chambers in communication, which process is simple and has high efficiency. During inflation, the description is made by taking that an inflation hole is provided in the central air chamber 103 as an example. Gas in the central air chamber 103 can enter the edge air chamber from the channel, to realize inflation of the central air chamber 103 and the edge air chamber at the same time, thus the inflating efficiency is high. After the inflation is completed, the closed annular pull strap functions as strengthening, edges of the bed body 100 are not easy to collapse, and the inflatable bed is comfortable to use and highly safe. Meanwhile, since the overall structure of the closed annular pull strap is not destroyed, the closed annular pull strap has strong tensile strength, is not easily damaged in use, and has a long service lifetime and a low use cost.

Detailed structures of the novel inflatable bed provided in the present embodiment are illustrated below.

Referring to FIG. 1-FIG. 4, a novel inflatable bed provided in the present embodiment includes a bed body 100, a first closed annular pull strap 200, a second closed annular pull strap 300, and a plurality of reinforcing pull straps 400. The first closed annular pull strap 200 and the second closed annular pull strap 300 are both welded to the bed body 100, wherein the first closed annular pull strap 200 and the bed body 100 together define a first edge air chamber 101, the second closed annular pull strap 300 and the bed body 100 together define a second edge air chamber 102, the bed body 100, the first closed annular pull strap 200, and the second closed annular pull strap 300 together define a central air chamber 103, and the first edge air chamber 101 and the second edge air chamber 102 are both provided around the central air chamber 103 and located on two opposite sides of the central air chamber 103.

Figure 4:
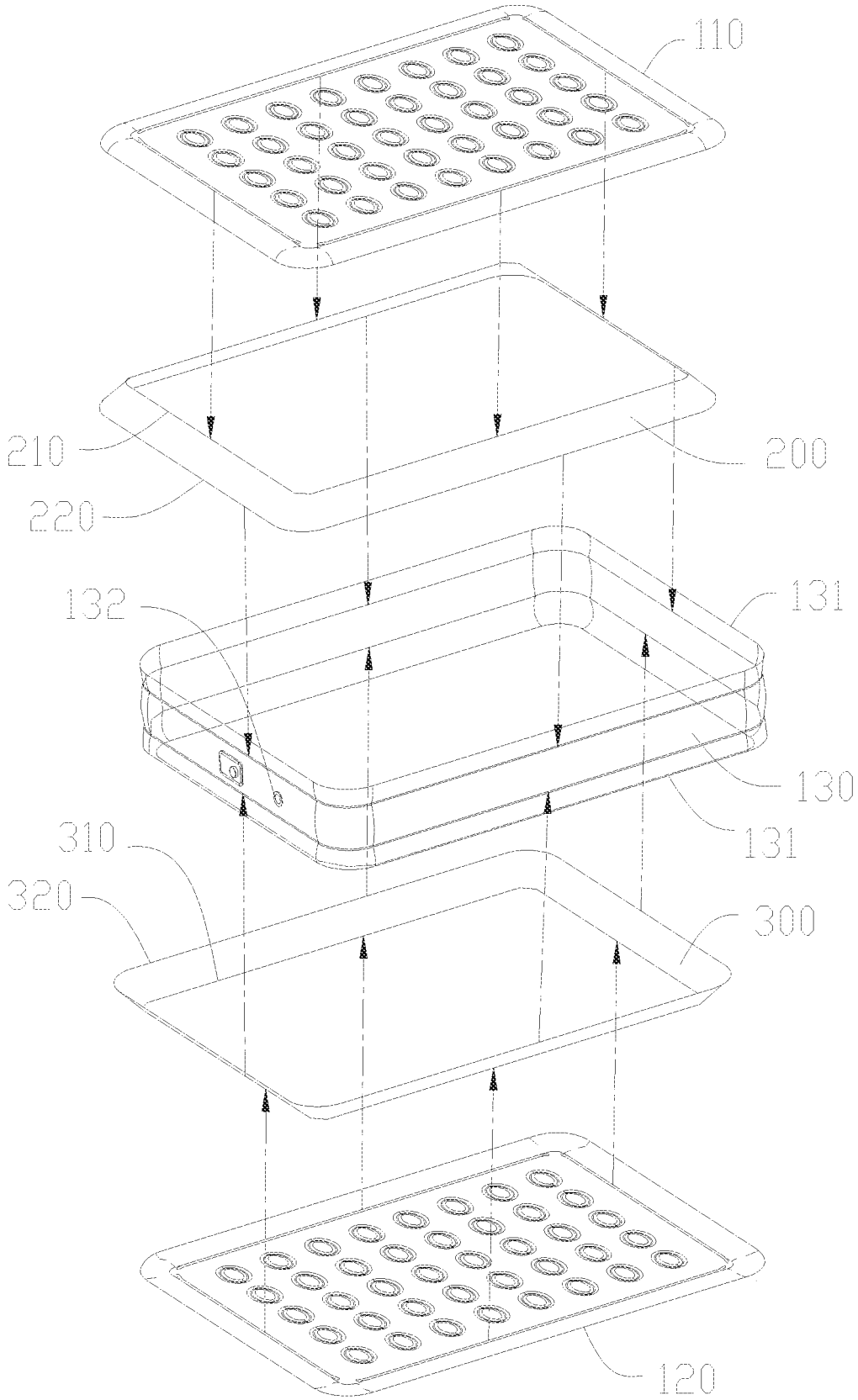
FIG. 4 is an exploded structural schematic diagram of the novel inflatable bed in an embodiment in the present disclosure.

Referring to FIG. 4, optionally, the bed body 100 is in a cuboid shape, the bed body 100 has a top wall 110, a surrounding wall 130, and a bottom wall 120, wherein the top wall 110 and the bottom wall 120 are both square, and each corner of the top wall 110 and the bottom wall 120 is a rounded corner, thereby reducing stress concentration. Each reinforcing pull strap 400 is of a hollow structure, two ends of each reinforcing pull strap 400 are respectively connected to the top wall 110 and the bottom wall 120, and a plurality of reinforcing pull straps 400 may be arranged in a rectangular array. The surrounding wall 130 is in a square barrel shape, the surrounding wall 130 has two oppositely disposed openings 131, each opening 131 is a square opening, the top wall 110 and the bottom wall 120 are both welded to the surrounding wall 130, and the top wall 110 and the bottom wall 120 respectively seal the two openings 131. It should be understood that the top wall 110 and the surrounding wall 130 may be welded into one piece by a heat-sealing process, and the bottom wall 120 and the surrounding wall 130 may also be welded into one piece by a heat-sealing process. Alternatively, in other embodiments, the top wall 110 and the surrounding wall 130 may be welded into one piece by a bonding process, and the bottom wall 120 and the surrounding wall 130 may be welded into one piece by a bonding process. That is to say, the welding process described in the present embodiment may be a heat-sealing process, or a bonding process, etc. Meanwhile, an inflation hole and an exhaust hole 132 are provided on the surrounding wall 130, wherein an inflator pump 500 is mounted at the inflation hole, and gas can be charged into the central air chamber after the inflator pump 500 is started. An exhaust valve is provided at the exhaust hole 132, and when exhaust is required, it just needs to open the exhaust valve.

Referring to FIG. 4, optionally, a region enclosed by the first closed annular pull strap 200 is a trapezoidal platform, the first closed annular pull strap 200 has a first annular edge 210 and a second annular edge 220 opposite to each other, the first annular edge 210 and the second annular edge 220 are both square, four corners of each of the first annular edge 210 and the second annular edge 220 are all provided as rounded corners, and a position where each corner is located may be understood as an arc-shaped bending portion. An area of a region enclosed by the first annular edge 210 is smaller than that of a region enclosed by the second annular edge 220, the first annular edge 210 is welded to the top wall 110, and four broken portions 001 are formed after the first annular edge 210 is welded to the top wall 110. In this way, four first weld seams 002 are formed after the first annular edge 210 is welded to the top wall 110, and the four first weld seams 002 are arranged at intervals in a circumferential direction of the first annular edge 210, in other words, adjacent first weld seams 002 form one broken portion 001, and the number of broken portions 001 is four. Meanwhile, the four broken portions 001 cooperate with the four bending portions of the first annular edge 210 in one-to-one correspondence, and each broken portion 001 is located at a corresponding bending portion. By providing the broken portions 001 at the bending portions of the first annular edge 210, situations such as complicated stress and stress concentration at the bending portions can be effectively improved, and the first closed annular pull strap 200 is not easy to break at the bending portions, thereby improving the tensile strength of the inflatable bed and prolonging the service lifetime of the inflatable bed. The second annular edge 220 of the first closed annular pull strap 200 is welded to the surrounding wall 130 in a heat-sealing manner, and a second weld seam 003 of an annular shape is formed at a position where the second annular edge 220 is welded to the surrounding wall 130. With such a design, four channels are formed between the first annular edge 210 and the top wall 110, to function as making the first edge air chamber 101 and the central air chamber 103 in communication. The second annular edge 220 and the surrounding wall 130 are all welded, i.e., an annular weld seam is formed, and connection strength is high.

Referring to FIG. 4, optionally, a region enclosed by the second closed annular pull strap 300 is a trapezoidal platform, the second closed annular pull strap 300 has a third annular edge 310 and a fourth annular edge 320 opposite to each other, the third annular edge 310 and the fourth annular edge 320 are both square, four corners of each of the third annular edge 310 and the fourth annular edge 320 are all provided as rounded corners, and a position where each corner is located may be understood as an arc-shaped bending portion. An area of a region enclosed by the third annular edge 310 is smaller than that of a region enclosed by the fourth annular edge 320, the third annular edge 310 is welded to the bottom wall 120, and four broken portions 001 are formed after the third annular edge 310 is welded to the bottom wall 120. In this way, four third weld seams 004 are formed after the third annular edge 310 is welded to the bottom wall 120, and the four third weld seams 004 are arranged at intervals in a circumferential direction of the third annular edge 310, in other words, adjacent third weld seams 004 form one broken portion 001, and the number of broken portions 001 is four. Meanwhile, the four broken portions 001 cooperate with the four bending portions of the third annular edge 310 in one-to-one correspondence, and each broken portion 001 is located at a corresponding bending portion. By providing the broken portions 001 at the bending portions of the third annular edge 310, situations such as complicated stress and stress concentration at the bending portions can be effectively improved, and the second closed annular pull strap 300 is not easy to break at the bending portions, thereby improving the tensile strength of the inflatable bed and prolonging the service lifetime of the inflatable bed. The fourth annular edge 320 of the second closed annular pull strap 300 is welded to the surrounding wall 130 in a heat-sealing manner, and a fourth weld seam 005 of an annular shape is formed at a position where the fourth annular edge 320 is welded to the surrounding wall 130 forms. With such a design, four channels are formed between the third annular edge 310 and the bottom wall 120, to function as making the first edge air chamber 101 and the central air chamber 103 in communication. The fourth annular edge 320 and the surrounding wall 130 are all welded, i.e., an annular weld seam is formed, and connection strength is high.

It should be noted that, after the first closed annular pull strap 200 and the second closed annular pull strap 300 are connected to the bed body 100, the first closed annular pull strap 200 and the second closed annular pull strap 300 may be arranged symmetrically.

In addition, the broken portions 001 are not limited to be provided at the bending portions, and may also be at any position on the first annular edge 210 and the third annular edge 310.

In the present embodiment, optionally, the novel inflatable bed further includes an inflatable pillow (not shown), and the inflatable pillow is detachably connected to an outer surface of the top wall 110. For example, the inflatable pillow can be detachably connected to the top wall 110 by means of a structure such as a snap, a zipper, a button or a velcro tape, and by providing the inflatable pillow which is inflated when being used and is in a deflated state when not being use, the use is flexible, meeting requirements of different users in different scenarios.

Figure 3:
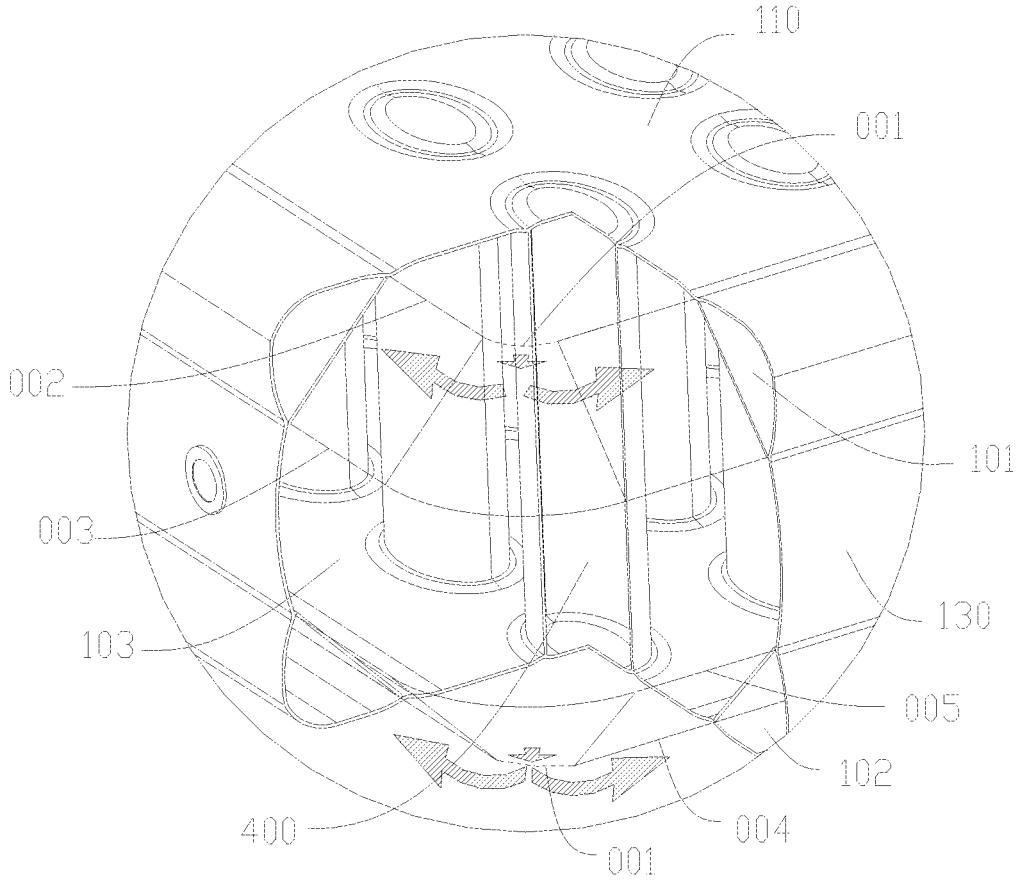
FIG. 3 is a local enlarged structural schematic diagram of FIG. 2.

With reference to FIG. 1 or FIG. 3, for the novel inflatable bed provided in the present embodiment, the closed annular pull strap and the bed body are molded in one step by the heat-sealing process, in which not only a fixed connection between the closed annular pull strap and the bed body is achieved, but also the channel for making the edge air chamber and the central air chamber 103 in communication is formed, which process is simple, and has high processing efficiency and a low processing cost. Meanwhile, the overall structure of the closed annular pull strap is not destroyed; the closed annular pull strap has a strong tensile property, and has a long service lifetime and a low use cost.

The above are merely for preferred embodiments of the present disclosure and not intended to limit the present disclosure. For one skilled in the art, various modifications and variations can be made to the present disclosure. Any amendments, equivalent replacements, improvements and so on made within the spirit and principle of the present disclosure should be covered within the scope of protection of the present disclosure.

What is claimed is:

1. A novel inflatable bed, comprising:

a bed body with a main air chamber; and at least one closed annular pull strap, wherein the at least one closed annular pull strap has two annular edges, and the at least one closed annular pull strap is provided in the main air chamber, wherein the two annular edges are a first annular edge and a second annular edge respectively, the bed body comprises a top wall, a surrounding wall, and a bottom wall, wherein the surrounding wall has two openings, the top wall and the bottom wall are both in sealed connection with the surrounding wall, so as to close the two openings, the first annular edge is welded to the top wall or the bottom wall, and the second annular edge is welded to the surrounding wall, so that the main air chamber is separated by the at least one closed annular pull strap to form a central air chamber and an edge air chamber, and a weld seam formed by welding the first annular edge to the top wall or the bottom wall has at least one broken portion, so as to form a channel making the central air chamber and the edge air chamber in communication at the at least one broken portion, and the second annular edge and the surrounding wall are all welded to form an annular weld seam.

2. The novel inflatable bed according to claim 1, wherein the weld seam formed by welding the first annular edge to the top wall or the bottom wall has a plurality of broken portions, and the plurality of the broken portions are arranged at intervals in a circumferential direction of the first annular edge.

3. The novel inflatable bed according to claim 2, wherein the first annular edge has a plurality of bending portions arranged at intervals in a circumferential direction thereof, the plurality of the broken portions cooperate with the plurality of the bending portions in one-to-one correspondence, and each of the broken portions is located at the corresponding bending portion.

4. The novel inflatable bed according to claim 1, wherein two closed annular pull straps are provided, one of the two closed annular pull straps is welded to both the top wall and the surrounding wall, and the other of the two closed annular pull straps is welded to both the bottom wall and the surrounding wall.

5. The novel inflatable bed according to claim 4, wherein the first annular edge or the second annular edge is welded to a bed wall of the bed body by a heat-sealing process.

6. The novel inflatable bed according to claim 1, wherein the novel inflatable bed further comprises an inflator pump, the inflator pump is mounted on the bed body, and the inflator pump is configured to inflate the central air chamber or the edge air chamber.

7. The novel inflatable bed according to claim 1, wherein the novel inflatable bed further comprises a reinforcing pull strap, the reinforcing pull strap is provided in the central air chamber, and the reinforcing pull strap is fixedly connected to a bed wall of the bed body.

8. The novel inflatable bed according to claim 2, wherein two closed annular pull straps are provided, one of the two closed annular pull straps is welded to both the top wall and the surrounding wall, and the other of the two closed annular pull straps is welded to both the bottom wall and the surrounding wall.

9. The novel inflatable bed according to claim 3, wherein two closed annular pull straps are provided, one of the two closed annular pull straps is welded to both the top wall and the surrounding wall, and the other of the two closed annular pull straps is welded to both the bottom wall and the surrounding wall.

* * * * *